US009826783B2

(12) United States Patent
Washington et al.

(10) Patent No.: US 9,826,783 B2
(45) Date of Patent: Nov. 28, 2017

(54) CHEST BINDER

(71) Applicant: Marli Washington Design, LLC, Upper Marlboro, MD (US)

(72) Inventors: Marli J. Washington, Upper Marlboro, MD (US); Karen Larenas, Upper Marlboro, MD (US)

(73) Assignee: Marli Washington Design, LLC, Upper Marlboro, MD (US)

( * ) Notice: Subject to any disclaimer, the term of this patent is extended or adjusted under 35 U.S.C. 154(b) by 227 days.

(21) Appl. No.: 14/751,241

(22) Filed: Jun. 26, 2015

(65) Prior Publication Data

US 2016/0374405 A1 Dec. 29, 2016

(51) Int. Cl.
*A41C 1/00* (2006.01)
*A41C 1/02* (2006.01)

(52) U.S. Cl.
CPC ..... *A41C 1/02* (2013.01); *A41B 2400/38* (2013.01)

(58) Field of Classification Search
CPC ..... A41C 3/00; A41C 3/0064; A41C 3/0028; A41C 3/08; A41D 9/00; A41D 9/06; A41D 27/00
USPC ..... 450/8–10, 58, 66, 74, 75, 79, 93; 2/69, 2/67, 113–115, 78.1–78.4; 602/19
See application file for complete search history.

(56) References Cited

U.S. PATENT DOCUMENTS 2,662,522 A * 12/1953 Muller ..... A61F 13/143 2/463
2,723,396 A * 11/1955 Stack ..... A61F 5/03 450/58
3,194,234 A * 7/1965 Duckman ..... A61F 15/006 128/95.1
3,968,803 A * 7/1976 Hyman ..... A61F 13/145 450/58
4,583,544 A * 4/1986 Flanagan ..... A41C 3/0057 2/67
4,804,351 A * 2/1989 Raml ..... A41C 3/0064 2/DIG. 1
4,816,005 A * 3/1989 Braaten ..... A41C 3/02 450/58
4,909,711 A * 3/1990 Burgbacher ..... F04D 29/325 415/218.1
4,957,466 A * 9/1990 Hopps ..... A41C 3/0057 2/113

(Continued)

OTHER PUBLICATIONS

"Wetsuit Knowledge Base," published on www.boardridersguide.com at least as early as Jan. 6, 2013, retrieved from the Internet Archive on Aug. 19, 2015.

*Primary Examiner* — Gloria Hale
(74) *Attorney, Agent, or Firm* — Panitch Schwarze Belisario & Nadel LLP

(57) ABSTRACT

A chest binder for holding breast tissue substantially flat relative to a thorax of a wearer's body has a front panel of an elasticized fabric, an inner front panel of a non-stretch material, and a back panel of the elasticized fabric. The front panel and the inner front panel are at least partially joined along corresponding peripheral edges by seams of stitching and are slidable with respect to each other between the peripheral edges. The front panel and the back panel are at least partially joined along corresponding peripheral edges by seams of stitching. The beast tissue of the wearer is held substantially flat relative to the thorax of the wearer's body when the chest binder covers the thorax.

14 Claims, 4 Drawing Sheets

(56) References Cited

U.S. PATENT DOCUMENTS

| | | | | | |
|---|---|---|---|---|---|
| 5,011,452 | A * | 4/1991 | Kelly | A41C 3/0028 | 450/58 |
| 5,060,648 | A * | 10/1991 | Zarkesh | A61F 7/10 | 450/79 |
| 5,427,563 | A * | 6/1995 | Manning | A61F 7/02 | 2/73 |
| 5,527,270 | A * | 6/1996 | Chase | A61F 13/145 | 450/58 |
| 6,015,331 | A * | 1/2000 | Ioakim | A41C 3/04 | 450/37 |
| 6,135,975 | A * | 10/2000 | Johnstone | A41C 3/0064 | 602/19 |
| 6,585,673 | B1 * | 7/2003 | Bass | A61F 7/02 | 128/845 |
| 8,257,138 | B2 * | 9/2012 | Smith | A41C 3/00 | 450/74 |
| 8,523,631 | B2 | 9/2013 | Smith | | |
| 8,702,469 | B2 * | 4/2014 | Hurd | A41B 17/00 | 450/74 |
| 8,827,764 | B2 | 9/2014 | Caruso et al. | | |
| 8,900,032 | B2 | 12/2014 | Punsal | | |
| 2002/0022433 | A1 * | 2/2002 | Yeung | A41C 3/0014 | 450/70 |
| 2011/0230119 | A1 * | 9/2011 | Thompson | A41B 17/00 | 450/10 |
| 2014/0182043 | A1 * | 7/2014 | Moore | A41D 15/005 | 2/69 |
| 2014/0317823 | A1 * | 10/2014 | Hanson | A41D 15/005 | 2/69 |
| 2015/0208734 | A1 * | 7/2015 | Callahan | A41C 3/08 | 450/30 |

* cited by examiner

CHEST BINDER

BACKGROUND OF THE INVENTION

The present invention relates to a chest binder. More particularly, the present invention relates to a chest binder for holding breast tissue substantially flat relative to a thorax of a wearer's body.

A mismatch between sex and gender identity can lead some people to experience distressing and uncomfortable feelings that may lead to a recognized medical condition called gender identity disorder (GID) also known as gender dysphoria. People with GID have a strong and persistent desire to live according to their gender identity, rather than their biological sex. Chest binding is one way for many transgender men to curb GID and is a fairly common step in female-to-male transition.

Because chest binders are compression garments, they can seriously restrict breathing, cause fluid build-up in your lungs and other serious injuries, such as broken ribs. Further, chest binder can cause pain, discomfort, sweating, and irritation.

Accordingly, there is a need for a garment that holds breast tissue substantially flat relative to a thorax of a wearer's body while being safe and comfortable to wear.

BRIEF SUMMARY OF THE INVENTION

Briefly stated, one embodiment of the present invention is directed to a chest binder for holding breast tissue flat relative to a thorax of a wearer's body. The chest binder comprises an outer front panel of an elasticized fabric, an inner front panel of a non-stretch material, and an outer back panel of the elasticized fabric. The outer front panel and the inner front panel are at least partially joined along corresponding peripheral edges by seams of stitching and are slidable with respect to each other between the peripheral edges. The outer front panel and the outer back panel are at least partially joined along corresponding peripheral edges by seams of stitching. The beast tissue of the wearer is held substantially flat relative to the thorax of the wearer's body when the chest binder covers the thorax.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, the drawings show embodiments which are presently preferred. It should be understood, however, that the invention is not limited to the precise arrangements and instrumentalities shown.

In the drawings.

DETAILED DESCRIPTION OF THE INVENTION

Figure 3:
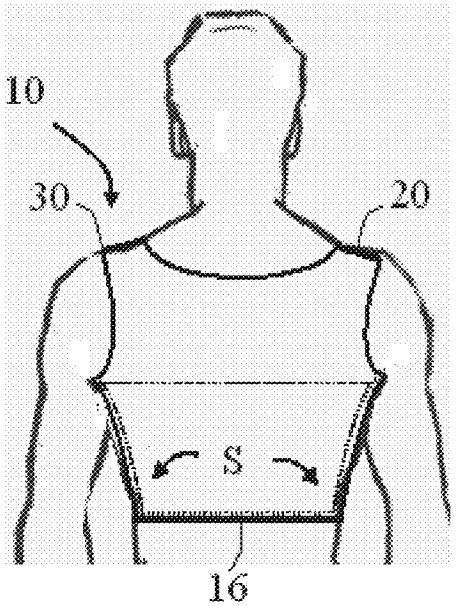
FIG. 3 is a back elevation view of the chest binder of FIG. 1
Figure 2:
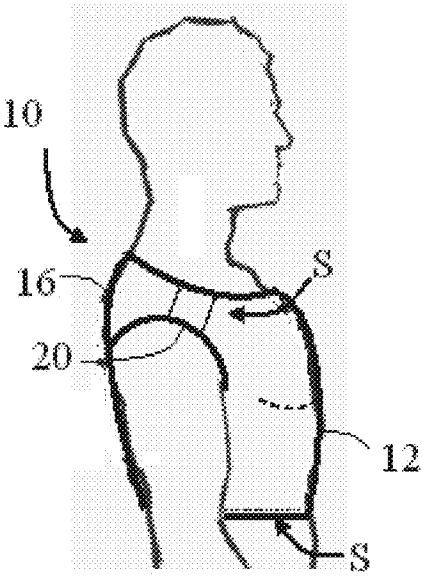
FIG. 2 is a side elevation view for the chest binder of FIG. 1.
Figure 1:
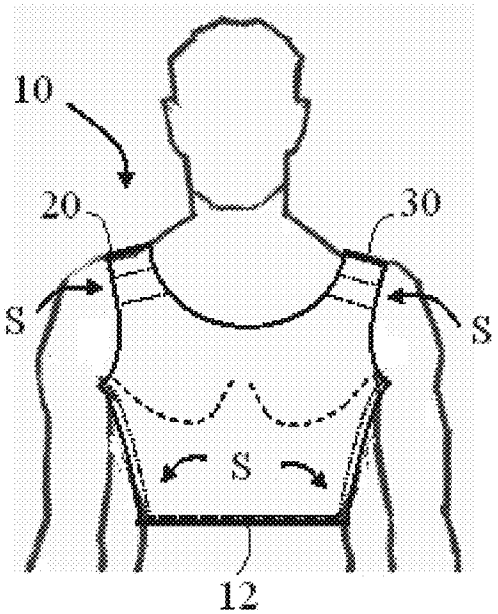
FIG. 1 is a front elevation view of a first preferred embodiment of the chest binder in accordance with the present invention.

Reference will now be made in detail to embodiments of the invention, examples of which are illustrated in the accompanying drawings. The terminology used in the description of the invention herein is for the purpose of describing particular embodiments only and is not intended to be limiting of the invention.

As used in the description of the invention and the appended claims, the singular forms "a", "an" and "the" are intended to include the plural forms as well, unless the context clearly indicates otherwise. The words "and/or" as used herein refers to and encompasses any and all possible combinations of one or more of the associated listed items. The words "comprises" and/or "comprising," when used in this specification, specify the presence of stated features, integers, steps, operations, elements, and/or components, but do not preclude the presence or addition of one or more other features, integers, steps, operations, elements, components, and/or groups thereof The words "right," "left," "lower" and "upper" designate directions in the drawings to which reference is made. The terminology includes the words noted above, derivatives thereof and words of similar import.

The following description is directed towards various embodiments of a chest binder in accordance with the present invention.

Referring to the drawings in detail, where like numerals indicate like elements throughout, there is shown in FIGS. 1-7 a first preferred embodiment of the chest binder, generally designated 10, and hereinafter referred to as the "chest binder" 10 in accordance with the present invention. The chest binder 10 is for holding breast tissue substantially flat relative to the thorax of a wearer's body.

The chest binder 10 comprises an outer front panel 12 of an elasticized fabric, an inner front panel 14 of a non-stretch material, and an outer back panel 16 of the elasticized fabric. The outer front panel 12 and the inner front panel 14 are at least partially joined along corresponding peripheral edges by seams "S" of stitching such that the outwardly facing surface of the inner front panel is adjacent the inwardly facing surface of the outer front panel and the inner and outer front panels are slidable with respect to each other between the peripheral edges. The outer front panel 12 and the outer back panel 16 are at least partially joined along corresponding peripheral edges by seams "S" of stitching. The breast tissue of the wearer is held substantially flat relative to the thorax of the wearer's body when the chest binder covers the thorax.

In some embodiments, the elasticized fabric may comprise nylon fiber and spandex (or elastane) and may be exactly 80% nylon fiber and 20% spandex fiber, suggestedly at least about 70% nylon fiber and 30% spandex fiber, desirably 75% or more nylon fiber and 25% or less spandex fiber, preferably between about 85% nylon fiber and 15% spandex fiber, and less preferably up to 90% nylon and 10% spandex but no more than 95% nylon and 5% spandex. In some embodiments, the elasticized fabric may have directionally dependent moduli of elasticity and therefore able to sustain a first strain in a first direction greater than a second strain in a second direction orthogonal to the first direction.

In some embodiments, the non-stretch material may comprise cotton fiber and polyester fiber and may be exactly 80% cotton fiber and 20% polyester fiber, suggestedly at least about 70% cotton fiber and 30% polyester fiber, desirably 75% or more cotton fiber and 25% or less polyester fiber, preferably between about 85% cotton fiber and 15% polyester fiber, and less preferably up to 90% cotton and 10% polyester but no more than 95% cotton and 5% polyester.

Figure 7:
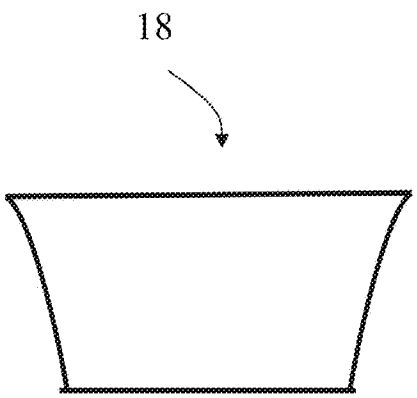
FIG. 7 is a back elevation view of the inner back panel of the chest binder of FIG. 1.

Referring to FIG. 7, preferably, the chest binder 10 has an inner back panel 18 of the elasticized fabric and the outer back panel 16 and the inner back panel 18 are least partially joined along corresponding peripheral edges by seams of stitching.

Figure 6:
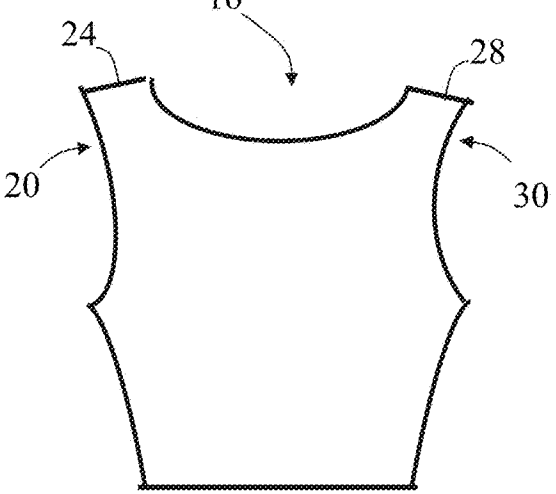
FIG. 6 is back elevation view of the outer back panel of the chest binder of FIG. 1.
Figure 5:
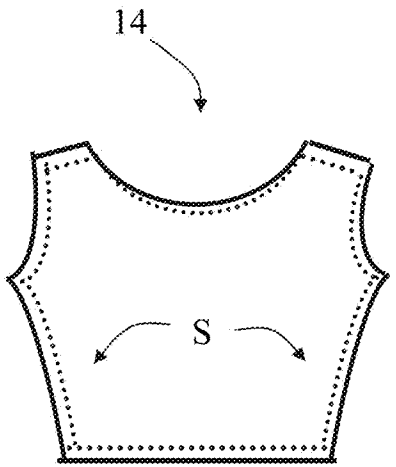
FIG. 5 is a front elevation view of the inner front panel of the chest binder of FIG. 1.
Figure 4:
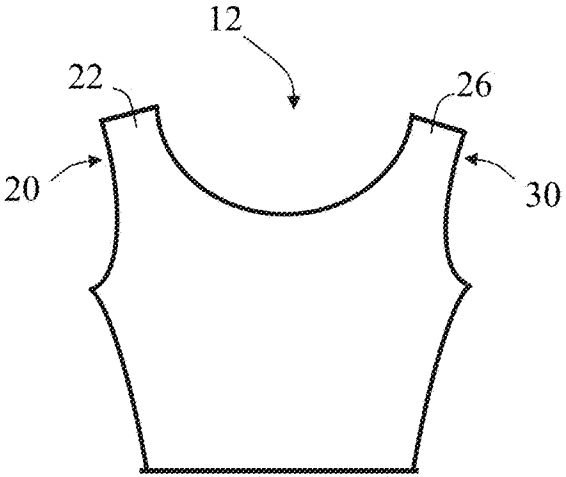
FIG. 4 is a front elevation view of the outer front panel of the chest binder of FIG. 1.

Referring to FIGS. 4 and 6, in some embodiments, the outer front panel 12 includes a right front-panel portion 22 of a right shoulder panel 20 and a left front-panel portion 24 of a left shoulder panel 30 and the outer back panel 16 includes a right back-panel portion 26 of the right shoulder panel 20 and a left back-panel portion 28 of the left shoulder panel 30. In such embodiments, the right front-panel portion 22 of the right shoulder panel 20 and the right back-panel portion 24 of the right shoulder panel 20 are joined along corresponding peripheral edges by seams of stitching and the left front-panel portion 26 of the left shoulder panel 30 and the left back-panel portion 28 of the left shoulder panel 30 are joined along corresponding peripheral edges by seams of stitching.

Preferably, the right shoulder panel 20 and the left shoulder panel 30 are generally shoulder-strap shaped giving the chest binder 10 the general overall shape of a tank top. Alternatively, in some embodiments, the right shoulder panel 20 and the left shoulder panel 30 may have a sleeve-like shape (not shown) giving the chest binder 10 the general overall shape of a t-shirt with either a semi-circular or "V" shaped neck line.

Figure 8:
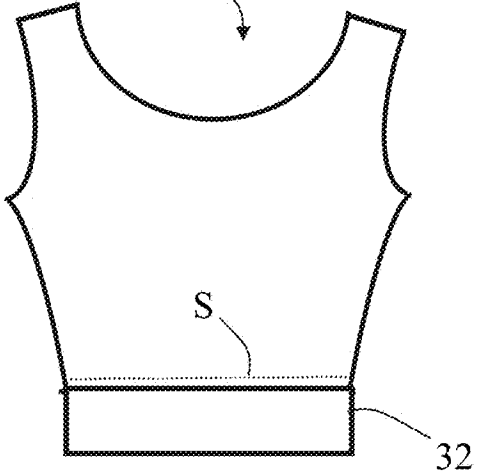
FIG. 8 is a front elevation view of the lower front panel attached to the outer front panel of the chest binder of FIG. 1.
Figure 9:
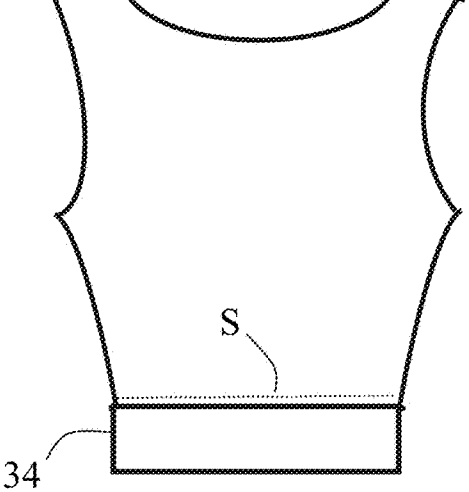
FIG. 9 is a back elevation view of the lower back panel attached to the outer back panel of the chest binder of FIG. 1.

Referring to FIGS. 8 and 9, in some embodiments, a lower front panel 32 of the elasticized fabric is at least partially joined to a bottom peripheral edge of the outer front panel 12 by a seam "S" of stitching and a lower back panel 34 of the elasticized fabric is at least partially joined to a bottom peripheral edge of the outer back panel 16 by a seam "S" of stitching, wherein the lower front panel 32 and the lower back panel 34 extend beyond the thorax of the wearer's body when the chest binder 10 covers the thorax.

Figure 11:
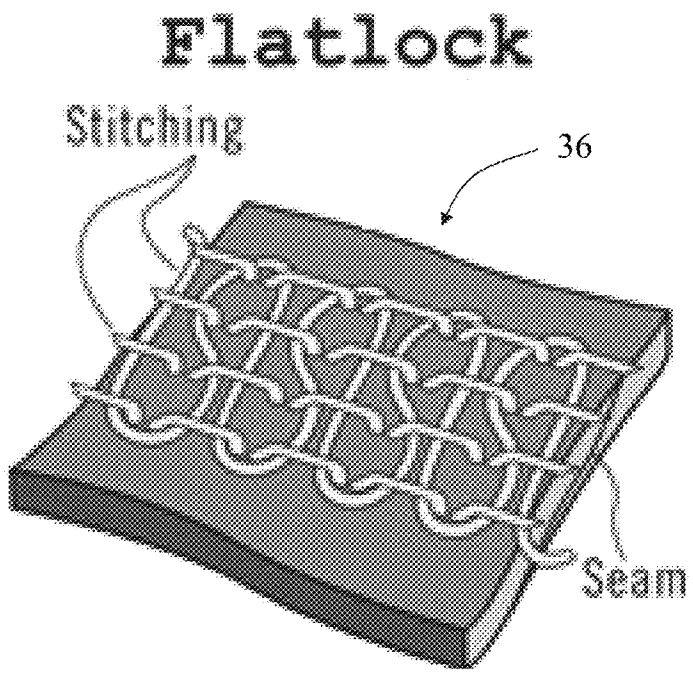
FIG. 11 is a top perspective view of another preferred stitching for peripheral edges of the inner front panel of the chest binder of FIG. 1.
Figure 10:
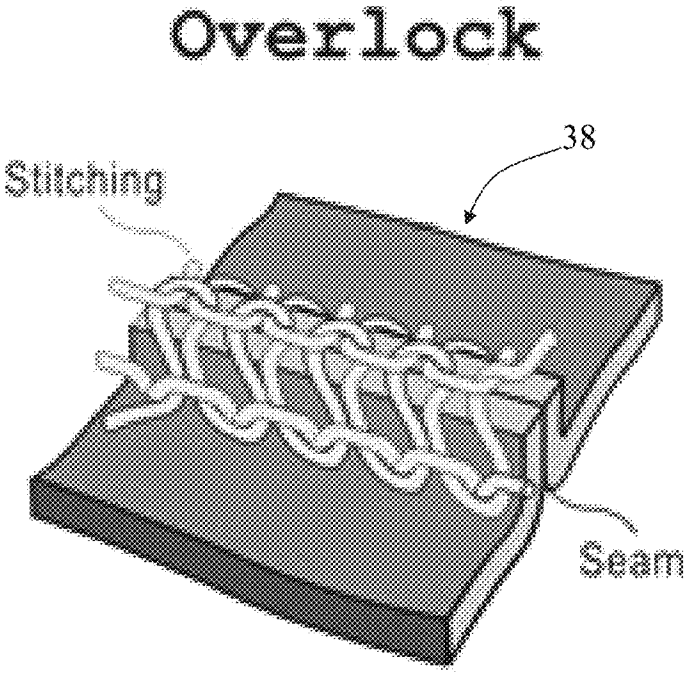
FIG. 10 is a top perspective view of a preferred seam of stitching for the chest binder of FIG. 1.

Referring to FIGS. 10 and 11, in some embodiments of the chest binder 10 the seams of stitching are seams of flat lock stitching and at least one portion of a peripheral edge of the inner front panel 14 is bound by overlock stitching. In other embodiments, the seams of stitching and the stitching for the binding of at least one portion of a peripheral edge of the inner front panel 14 may be any well known stitch configuration used in the textile are for stitching elasticized fabric.

In use, the wearer dons the chest binding such that the chest binder encircles the thorax with the inwardly facing surface of the inner front liner adjacent the breast tissue and the elasticized fabric causes a compression of the breast tissue of the wearer thereby holding the breast tissue substantially flat relative to the thorax of the wearer's body The foregoing detailed description of the invention has been disclosed with reference to specific embodiments. However, the disclosure is not intended to be exhaustive or to limit the invention to the precise forms disclosed. Those skilled in the art will appreciate that changes could be made to the embodiments described above without departing from the broad inventive concept thereof. Therefore, the disclosure is intended to cover modifications within the spirit and scope of the present invention as defined by the appended claims.

We claim:

1. A chest binder for holding breast tissue substantially flat relative to a thorax of a wearer's body, the chest binder comprising:

an outer front panel of an elasticized fabric;

an inner front panel of a non-stretch material; and a outer back panel of the elasticized fabric, wherein the outer front panel and the inner front panel are at least partially joined along corresponding peripheral edges by seams of stitching and are slidable with respect to each other between the peripheral edges, wherein the outer front panel and the outer back panel are at least partially joined along corresponding peripheral edges by seams of stitching, and wherein the chest binder holds the breast tissue of the wearer's body substantially flat relative to the thorax when the chest binder circumscribes the thorax.

2. The chest binder according to claim 1, further comprising an inner back panel of the elasticized fabric, wherein the outer back panel and the inner back panel are least partially joined along corresponding peripheral edges by seams of stitching.

3. The chest binder according to claim 1, wherein:

the outer front panel includes a right front-panel portion of a right shoulder panel and a left front-panel portion of a left shoulder panel;

the outer back panel includes a right back-panel portion of the right shoulder panel and a left back-panel portion of the left shoulder panel; and the right front-panel portion of the right shoulder panel and the right back-panel portion of the right shoulder panel are joined along corresponding peripheral edges by seams of stitching, and the left front-panel portion of the left shoulder panel and the left back-panel portion of the left shoulder panel are joined along corresponding peripheral edges by seams of stitching.

4. The chest binder according to claim 3, wherein the right shoulder panel and the left shoulder panel are generally shoulder-strap shaped giving the chest binder a general overall shape of a tank top.

5. The chest binder according to claim 3, wherein the right shoulder panel and the left shoulder panel have a sleeve giving the chest binder a general overall shape of a t-shirt with either a semi-circular or V-shaped neck line.

6. The chest binder according to claim 1 further comprising a lower front panel of the elasticized fabric at least partially joined to a bottom peripheral edge of the outer front panel by a seam of stitching and a lower back panel of the elasticized fabric at least partially joined to a bottom peripheral edge of the outer back panel by a seam of stitching, wherein the lower front panel and the lower back panel extend beyond the thorax of the wearer's body when the chest binder covers the thorax.

7. The chest binder according to claim 1 wherein the seams of stitching are seams of flat lock stitching.

8. The chest binder according to claim 1 wherein at least one portion of the peripheral edges of the inner front panel is bound by overlock stitching.

9. The chest binder according to claim 1 wherein the elasticized fabric comprises nylon fiber and spandex fiber.

10. The chest binder according to claim 9 wherein the elasticized fabric comprises at least about eighty percent nylon fiber and twenty percent spandex fiber.

11. The chest binder according to claim 1 wherein the non-stretch material comprises cotton fiber and polyester fiber.

12. The chest binder according to claim 11 wherein the non-stretch material comprises at least about eighty percent cotton fiber and twenty percent polyester fiber.

13. A chest binder for holding breast tissue substantially flat to a thorax of a wearer's body, the chest binder comprising:

an outer front panel of an elasticized fabric;

an inner front panel of a non-stretch material;

an outer back panel of the elasticized fabric; and an inner back panel of the elasticized fabric, wherein the outer front panel and the inner front panel are at least partially joined along corresponding peripheral edges by seams of flat lock stitching and are slidable with respect to each other between the peripheral edges, wherein the outer back panel and the inner back panel are least partially joined along corresponding peripheral edges by seams of flat lock stitching, wherein the outer front panel and the outer back panel are at least partially joined along corresponding peripheral edges by seams of flat lock stitching, and wherein the chest binder holds the breast tissue of the wearer's body substantially flat relative to the thorax of the wearer's body when the chest binder circumscribes the thorax.

14. The chest binder according to claim 13 wherein the elasticized fabric comprises at least about eighty percent nylon fiber and twenty percent spandex fiber and the non-stretch material comprises at least about eighty percent cotton fiber and twenty percent polyester fiber.

* * * * *